United States Patent [19]

Forni et al.

[11] Patent Number: 4,671,043

[45] Date of Patent: Jun. 9, 1987

[54] PROCESS AND DEVICE FOR OVERWRAPPING CONTAINERS AND THE LIKE

[75] Inventors: Angelo Forni, Bolonga; Piero Francesconi, Florence, both of Italy

[73] Assignees: Francesconi S.p.A., Florence; Robopac s.r.l., Bologna, both of Italy

[21] Appl. No.: 840,988

[22] Filed: Mar. 14, 1986

Related U.S. Application Data

[63] Continuation of Ser. No. 555,947, Nov. 29, 1983, abandoned.

[30] Foreign Application Priority Data

Jan. 25, 1983 [IT] Italy ..... 3316 A/83

[51] Int. Cl.[4] ..... B65B 11/02; B65B 13/02

[52] U.S. Cl. ..... 53/399; 53/441; 53/556

[58] Field of Search ..... 53/399, 441, 556, 587, 53/584; 206/83.5

[56] References Cited

U.S. PATENT DOCUMENTS

| | | | |
|---|---|---|---|
| 1,344,785 | 6/1920 | Angier | 53/399 |
| 4,235,062 | 11/1980 | Lancaster | 53/587 X |

FOREIGN PATENT DOCUMENTS

| | | | |
|---|---|---|---|
| 2256871 | 1/1975 | France | 53/588 |
| 1139278 | 1/1969 | United Kingdom . | |
| 1196351 | 6/1970 | United Kingdom . | |
| 1376819 | 12/1974 | United Kingdom . | |
| 1471054 | 4/1977 | United Kingdom . | |
| 1487512 | 10/1977 | United Kingdom . | |
| 1549137 | 7/1979 | United Kingdom . | |
| 1581674 | 12/1980 | United Kingdom . | |

OTHER PUBLICATIONS

"The Digest"—Sep. 1977—by Infra Pak.

"Lanringer Stretch Wrap System"—1976, by Lantech Inc.

*Primary Examiner*—John Sipos

*Attorney, Agent, or Firm*—Balogh, Kramer, Dvorak, Genova & Traub

[57] ABSTRACT

Disclosed herein is an invention that relates to packaging techniques and, in particular, to a process and a device for overwrapping containers and the like that hold edible products needing constant aeration.

The technical problem that has to be solved is how to achieve the foregoing without either obstructing the aeration or having to resort to the use of overwrapping nets that are particularly expensive and none too easy to place in position.

The solution to the problem is attained through a process for overwrapping containers and the like that hold edible products, and this consists in: reeling a band of film that can be tension deformed, dividing the said band into a plurality of strips placed, one at the side of the other, parallel to the axis of the said reel, and applying tension to the said strips prior to their being placed in contact with the containers to be overwrapped, in such a way as to obtain a shrinkage in width and a set spacing of one strip with respect to the other.

5 Claims, 4 Drawing Figures

FIG. 1
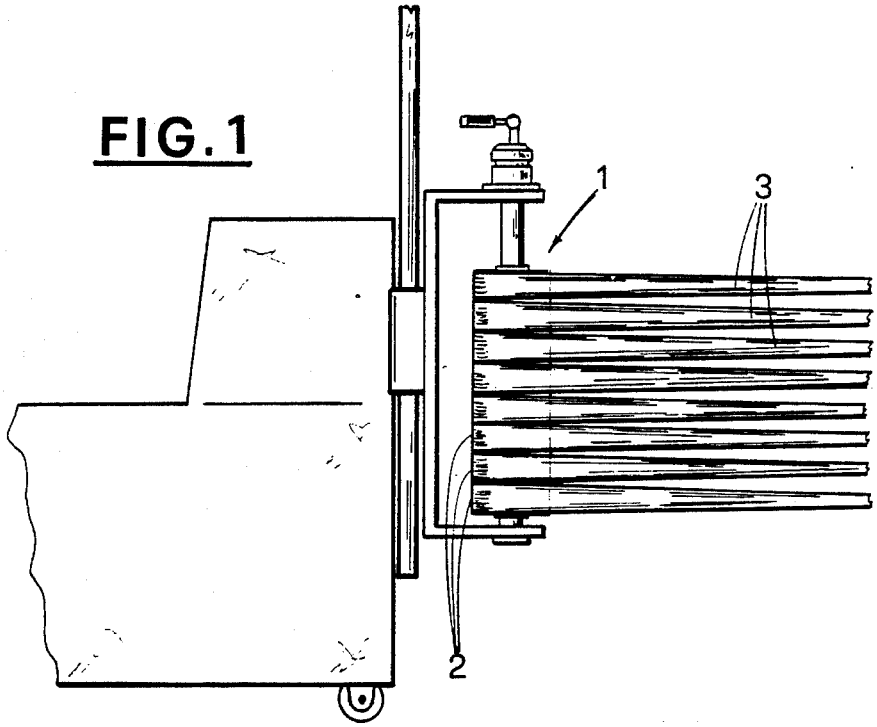
FIG. 2
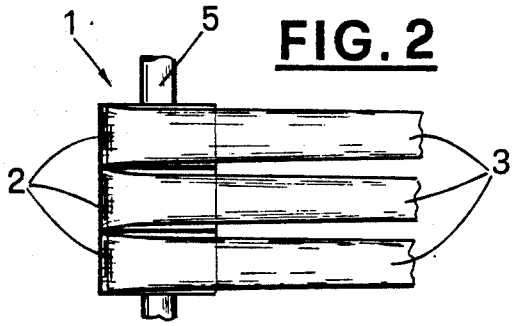
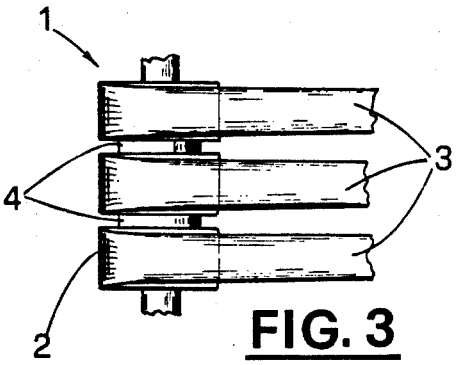
FIG. 3
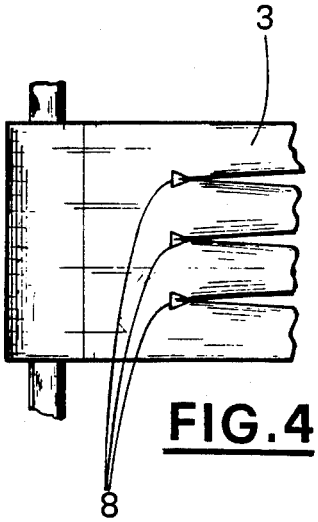
FIG. 4

PROCESS AND DEVICE FOR OVERWRAPPING CONTAINERS AND THE LIKE

This application is a continuation of application Ser. No. 555,947, filed Nov. 29, 1983 now abondoned.

BACKGROUND OF THE INVENTION

The invention relates to a process and a device for overwrapping containers and the like that hold edible or other products requiring aeration.

DESCRIPTION OF THE PRIOR ART

As is known, numerous products are placed, using specially provided items of equipment, into crates and boxes which, before being despatched, warehoused or put into refrigeration groups, are collated and rendered integral in batches.

Technically speaking, the said crates and boxes are "palletized" by being arranged in a number of stratified rows, overwrapped in a suitable covering material.

Using suitable means, the boxes in question can thus easily be displaced in batches.

To overwrap a batch of crates, boxes or containers of various types, use is essentially made of large strips of thin, self-adhesive, continuous structure film, or of nets of various structures that are wound around each batch of containers.

Films in continuous strips are, for example, made of polyethylene of relatively large dimensions, unwound from reels. The said films have the notable advantage of being inexpensive and, furthermore, of being easy to place in position thanks to their self-adhesion properties.

Despite the nets mentioned above being, instead, most costly and difficult to put around the batches, they are indispensable in all cases of overwrapping containers that hold products, such as food, where constant aeration is needed.

A typical case is constituted by boxes for fruit that are grouped together in batches by means of nets made of nylon, polypropylene or PVC etcetera.

This situation is obviously negative in the case of the palletization of containers that hold edible products because of the considerable additional cost of the said nets.

The foregoing is applicable at the very time when automatic machines are being marketed that overwrap containers in a particularly rapid way, thereby rendering the costs in respect of the said overwrapping machines practically insignificant.

SUMMARY OF THE INVENTION

The technical task that represents the basis of the invention is, therefore, to overcome the aforementioned problems pertaining to the palletization of containers that hold edible products.

Within the framework of the said technical task, one important object of the invention is to create a process and a device thanks to which continuous material in strips, of the type utilized up until now only for containers that do not hold edible products, can be advantageously used also for these.

Another important object of the invention is to create a process and a device thanks to which the overwrapping of containers and the like that hold edible products can, not only be effected rapidly at low costs, but also with the maximum guarantee of aeration for the palletized containers.

A further object of the invention is providing a solution according to which the overwrapping is realized not by means of one band wrapped several times around the container, but by means of a plurality of strips wrapped at the same time around it, placed one at the side of the other and sufficiently stretched during the overwrapping to obtain a striction of the strips and a set spacing of one strip with respect to the other, with a space between them sufficient to allow aeration but not so large to compromise the packing of the container.

The last but by no means least object of the invention is to create a process and a device such as to allow, in all cases, the most modern overwrapping machines to be used without substantial modifications having to be made thereto.

These objects and others too that will become more apparent from the text that follows are attained with the process according to the invention for overwrapping containers and the like that hold edible products, consisting in: reeling a band of film that can be tension deformed, dividing the said band into a plurality of strips placed, one at the side of the other, parallel to the axis of the said reel, and applying tension to the said strips prior to their being placed in contact with the containers to be overwrapped, in such a way as to obtain a shrinkage in width and a set spacing of one strip with respect to the other.

BRIEF DESCRIPTION OF THE DRAWINGS

Further characteristics and advantages of the invention will become more apparent from the description of one preferred but not sole form of embodiment, illustrated purely as an unlimited example on the accompanying drawings, in which:

FIG. 1 shows one form of embodiment that is currently preferred for the process and the device according to the invention;

FIG. 2 shows, in an isolated fashion, the process depicted in FIG. 1;

FIG. 3 shows a variant with respect to FIG. 2;

FIG. 4 shows, diagrammatically, a further form of embodiment for the process and the device according to the invention.

DESCRIPTION OF THE PREFERRED EMBODIMENT

With reference to FIGS. 1 and 2 in which the first preferred form of embodiment for the process according to the invention is shown, at 1 there is a reel onto which is wound a continuous band of film that can be tension deformed.

The said band occupies the full width of the reel and the latter is formed with an axial dimension, in the region of the winding axis, substantially greater than the diametric dimension thereof.

Then the reel 1 and the said band of film are divided into a plurality of reels 2, one at the side of the other. The diametric dimension of each reel is substantially greater than the axial dimension thereof. Furthermore, each reel 2 contains one strip 3 of film taken from a part of the said band of film.

In the solution illustrated, the reels 2 are closely side by side, one superposed over the other, along the axis of the reel 1, in such a way as virtually to reform the said reel.

A further stage in the process according to the invention envisages all the reels 2 being unwound contemporaneously in order to furnish the strips 3 to the containers to be overwrapped.

An original feature of the invention is that the strips 3 are subjected to tension prior to their wrapping around the said containers, in such a way as to obtain a shrinkage in width of the said strips.

As shown in the figures, this shrinkage brings about a set spacing of one strip 3 with respect to the other.

In the variant depicted in FIG. 3, the reels 2 are placed away, one from the other, by spacer disks 4 in such a way as to form overall one reel 1 of a width greater than that to which reference has been made above, and to space further the strips 3, one with respect to the other.

In the form of embodiment for the process illustrated in FIG. 4, the band of film wound onto the reel 1 is initially unrolled still not divided into the said strips 3, these being formed by dividing knives 8 (the spacing of these, one with respect to the other, being adjustable), while the said band is being unwound from the reel 1 and sent to the containers to be overwrapped.

The cutting operation takes place in a position immediately adjacent to the reel 1 and thus the tensioning effect is, in practice, experienced only by the strips 3.

The device according to the invention for overwrapping containers and the like that hold edible or other products is of the type in itself known, designed to furnish a film that can be deformed.

The original feature of the device is fundamentally that it comprises means for delivering the said film in the form of a plurality of strips, at least in the region of the containers to be overwrapped, as well as means designed to render taut that said plurality of strips, until they have been made to shrink, prior to being placed around the containers to which they are destined.

The degree of tautness is achieved by applying a predetermined force to resist the unreeling of the film from its reel.

These means can be made in various ways in accordance with current technical practices.

In the form of embodiment for the device that constitutes the process illustrated in FIGS. 1 and 2, it is necessary to have means of delivery comprising a support column 5 for a stack of reels 2.

Spacer disks 4 are also necessary for the variant shown in FIG. 3.

In the case depicted in FIG. 4, the means for delivering film that can be deformed can be virtually equivalent to those known.

The means designed to render taut the strips 3 of film that can be deformed, can comprise a clutch device that tends to slow down the unwinding of the film, or retarding means connnected to the said support column, or means for braking the rotation of the said support column on the overwrapping machine.

The invention thus achieves the preset objects and offers important advantages.

Using, the fact, rolls of film that can be deformed which in themselves are conventional, with bands of wound film of ample dimensions, it is possible to overwrap containers and similar that are to be palletized, using a number of side by side strips in between which there is a spacing.

Perfect aeration is thus possible and the overwrap is, therefore, also suitable for containers that hold edible products.

Furthermore, the property of self-adhesion of the film used is conserved.

The simplicity is stressed of the means with which the above mentioned important result has been achieved: the material just has to be divided into strips and subjected to tension.

It is also important to note that the process according to the invention can also be adopted on overwrapping machines already in existence after not particularly costly structural variations to the machines have been made.

The invention as described herein is liable to undergo numerous modifications and variants, all of which falling within the framework of the ideas behind the invention.

Furthermore, all parts may be substituted with other technically equivalent elements.

In practice, the materials used can vary infinitely, depending on the requirements, as can also the shapes and dimensions.

What is claimed is:

1. A process for wrapping a container in such manner as to provide aeration to the contents in said container, comprising unreeling a source of tension deformable wide film, sub-dividing said film into a plurality of narrow, parallel, side by side, adjacent strips, the sum of the widths of the strips being initially equal to the width of the unwound film, tensioning longitudinally said strips to obtain a reduction in the widths of said strips to develop empty space between adjacent strips, wrapping said plurality of transversely separated and reduced strips intimately about said container, and fastening the plurality of said reduced strips to said container.

2. A process according to claim 1, including the step of winding said film on a reel to provide said source of film.

3. A process according to claim 1, wherein the step of sub-dividing said film is obtained by slitting the film as it is unreeled.

4. A process according to claim 1, wherein the step of fastening the plurality of strips to said container is achieved with adhesive deposited on said film.

5. A process according to claim 1, including the step of applying a predetermined amount of force to resist the unreeling of said film.

* * * * *